US010280924B2

(12) United States Patent
Hökby

(10) Patent No.: US 10,280,924 B2
(45) Date of Patent: May 7, 2019

(54) PUMP AND METHOD FOR CHANGING THE PUMPING CAPACITY OF A PUMP

(71) Applicant: Sulzer Management AG, Winterthur (CH)

(72) Inventor: Nils Hökby, Saltsjöbaden (SE)

(73) Assignee: SULZER MANAGEMENT AG, Winterthur (CH)

( * ) Notice: Subject to any disclaimer, the term of this patent is extended or adjusted under 35 U.S.C. 154(b) by 158 days.

(21) Appl. No.: 15/267,250

(22) Filed: Sep. 16, 2016

(65) Prior Publication Data

US 2017/0089343 A1 Mar. 30, 2017

(30) Foreign Application Priority Data

Sep. 30, 2015 (EP) ..... 15187667

(51) Int. Cl.
*F04D 1/10* (2006.01)
*F04D 13/06* (2006.01)
(Continued)

(52) U.S. Cl.
CPC ..... *F04D 1/10* (2013.01); *F04D 13/06* (2013.01); *F04D 13/10* (2013.01); *F04D 15/0072* (2013.01); *F04D 29/22* (2013.01); *F04D 29/426* (2013.01); *F04D 29/4293* (2013.01); *F04D 29/445* (2013.01); *F04D 29/5806* (2013.01);
(Continued)

(58) Field of Classification Search
CPC ..... F04D 13/14; F04D 13/06; F04D 13/0606; F04D 13/10; F04D 1/06; F04D 1/10; F04D 29/628; F04D 15/0016; F04D 15/0072; F04D 29/5806; F04D 29/445;
(Continued)

(56) References Cited

U.S. PATENT DOCUMENTS 2,204,857 A 6/1940 Hollander
2,814,254 A * 11/1957 Litzenberg ..... F04D 1/06 310/54
(Continued)

FOREIGN PATENT DOCUMENTS

GB 117258 A * 2/1920 ..... F04D 1/10
GB 117258 A 2/1920
GB 2007770 A 5/1979

OTHER PUBLICATIONS

Extended European Search Report dated Mar. 22, 2016 in European Patent Application No. 15187667.9, filed Sep. 30, 2015.

*Primary Examiner* — Devon C Kramer
*Assistant Examiner* — David N Brandt
(74) *Attorney, Agent, or Firm* — Global IP Counselors, LLP

(57) ABSTRACT

A pump for fluids includes a pump housing, a power source enclosed within the housing, a drive shaft connected to the power source, at least one pump inlet arranged in the pump housing, a pump outlet arranged in the pump housing, a first impeller arranged within a first impeller chamber and rotated by the drive shaft, and a second impeller arranged within a second impeller chamber and rotated by the drive shaft. The pump is changeable between a first configuration in which the first and second impeller are arranged in parallel to provide a high pumping capacity, and a second configuration in which the first and second impeller are arranged in series to provide a pump with less pumping capacity.

15 Claims, 7 Drawing Sheets

(51) Int. Cl.

| | |
|---|---|
| ***F04D 15/00*** | (2006.01) |
| ***F04D 29/22*** | (2006.01) |
| ***F04D 29/42*** | (2006.01) |
| ***F04D 29/44*** | (2006.01) |
| ***F04D 29/62*** | (2006.01) |
| ***F04D 13/10*** | (2006.01) |
| ***F04D 29/58*** | (2006.01) |
| *F04D 29/70* | (2006.01) |

(52) U.S. Cl.
CPC ..... *F04D 29/628* (2013.01); *F04D 29/708* (2013.01)

(58) Field of Classification Search
CPC .... F04D 29/4293; F04D 29/426; F04D 29/22; F04D 29/708; F04C 28/02
See application file for complete search history.

(56) References Cited

U.S. PATENT DOCUMENTS 4,229,142 A * 10/1980 Le Dall ..... F04D 1/10 417/38
6,220,832 B1 * 4/2001 Schob ..... F04D 1/006 417/423.5

* cited by examiner

PUMP AND METHOD FOR CHANGING THE PUMPING CAPACITY OF A PUMP

CROSS-REFERENCE TO RELATED APPLICATIONS

This application claims benefit to EP 15187667.9, filed Sep. 30, 2015, the contents of which is hereby incorporated herein by reference.

BACKGROUND

Field of the Invention

The present invention relates to a pump for a fluid, and a method for changing the pumping capacity of a pump.

Background of the Invention

Different types of pumps are used within many different technical areas. One particular area where reliable and efficient pumps are essential is in mines or pits where pumps are running more or less constantly to drain water from the mine or pits.

When emptying flooded mines or pits there is a need to start with a pump with a high flow (Low head), i.e. a pump with high pumping capacity, to quickly drain as much water as possible in a short period of time. When pumping continues and the water level continually gets lower the need however is changed to a pump with a high head, i.e. a pump with lower pumping capacity, since the pump is only required to maintain the drained conditions in the mine or pit. Mostly the pump, when the drained condition is achieved, is replaced by another pump with reduced pumping capacity, i.e. a pump with a lower flow that is adapted for the requirements relating to maintaining the drained state in the mine or pit. No pumps available on the market today are adaptable to these completely different operational conditions and requires that more than one pump must be used to provide an efficient solution in the described situation. The additional pump, or pumps, generates additional work for the pump operator and requires that more than one pump are provided and maintained to work as intended.

SUMMARY

There is consequently a need for an improved pump that is able to work efficiently during different operational conditions.

The present invention relates to a pump for fluids that to at least some extent fulfils the needs defined above. The pump for fluids according to the invention comprises a pump housing; a power source (8) enclosed within said housing (11); a drive shaft connected to the power source (8); at least one pump inlet (14) arranged in the pump housing; a pump outlet (15) arranged in the pump housing; a first impeller arranged within a first impeller chamber and rotated by said drive shaft, and a second impeller arranged within a second impeller chamber and rotated by said drive shaft, wherein the pump is changeable between a first configuration in which the first and second impeller are arranged in parallel to provide a high pumping capacity, and a second configuration in which the first and second impeller are arranged in series to provide a pump with less pumping capacity.

The pump according to the invention fulfils the needs defined above since the possibility to change between the two configurations makes it possible to adapt the pumping capacity and characteristics of the pump to different required working conditions. This is very advantageous since the need for additional pumps with different pumping capacity and characteristics is eliminated, or at least reduced. The pump according to the invention is usable either in the first configuration, i.e. high pumping capacity and low head, and the second configuration, i.e. reduced pumping capacity and high head, when a higher pressure is desired.

The pump is furthermore advantageous since the power source is protected by the pump housing, and the pump could be designed in a compact and practical way with the power source integrated within the pump housing such that the pump could be moved easily in one piece.

The pump according to the invention furthermore reduces the need for transportation, installation, service and investments in additional pumps since different pumping characteristics could be provided by one single pump.

In one embodiment of the pump, the first and second impellers are arranged at different positions along the drive shaft. This design ensures that the desired function is achieved with a limited number of different components in the pump, i.e. only one power source and drive shaft that is arranged to power both impellers.

In one embodiment of the pump, the power source is an electrical or hydraulical power source arranged within the pump housing. Electrical and hydraulic power sources are reliable and ensure that the pump will work as intended for a long period of time.

In one embodiment of the pump, the housing encloses the power source and prevents that the fluid reach the power source. This embodiment is favourable since the entire pump could be lowered into the flooded mine, pits, cavity or compartment that need to be drained without the risk of being damaged.

In one embodiment of the pump, the first impeller chamber, in which the first impeller is arranged comprises at least one first impeller chamber inlet and at least one first impeller chamber outlet, and the second impeller chamber, in which the second impeller is arranged, comprises at least one second impeller chamber inlet and at least one second impeller chamber outlet, wherein, in the first configuration, the at least one first and second impeller chamber inlets are in fluid connection with the pump inlet, and the at least one first and second impeller chamber outlets are connected to the pump outlet, and, in the second configuration, the at least one first impeller chamber outlet is in fluid connection with the at least one second impeller chamber inlet and the at least one second impeller chamber outlet is connected to the pump outlet. This configuration of the different components in the pump provides a pump that is easily changed between the first and the second configuration, and provides a robust and reliable pump that is able to last for a long period of time.

In one embodiment of the pump, the first and second impeller chamber outlets are connected to conduits extending within the pump housing past the electrical power source to cool the electrical power source and prevent damages to the power source due to increased temperature within the pump housing.

In one embodiment of the pump, the at least one first and second impeller chamber outlets are connected to an annular space defined within the housing around the electrical power source to cool the electrical power source. This embodiment is advantageous since the annular space provides efficient cooling to electrical power source.

In one embodiment of the pump, the first and second impeller chamber each comprises two chamber outlets arranged adjacent to the outer periphery of the first and second impeller in radially opposite positions around the impeller. The two outlets of each impeller chamber arranged in radially opposite positions around the impeller reduces the loads on the impeller, the shaft and bearings since the forces from the water on the pump components are working in opposite directions.

In one embodiment of the pump, the outlets of the second impeller chamber are arranged between the outlets of the first impeller chamber in the pump housing. This embodiment is favourable since the four outlets extending past the electrical power source will provide efficient cooling to the power source, especially in when the pump is operated in the first configuration since water is flowing in all four outlets when the impellers are operated in parallel.

In one embodiment of the pump, the pump housing comprises a housing bottom structure that is removably attached to the housing. This embodiment is favourable since the removable bottom structure provides excellent access to interior of the housing.

In one embodiment of the pump, the pump furthermore comprises at least one redirection element, a covering element and at least one plugging plate that are fitted when the pump is operated in the second configuration.

In one embodiment of the pump, the redirecting element and the cover element are arranged to connect the first impeller chamber outlet with the second impeller chamber inlet.

In one embodiment of the pump, the redirecting element is designed to connect the first impeller chamber outlet to the second impeller chamber inlet and direct the flow of fluid from the first impeller chamber to the second impeller.

In one embodiment of the pump, the covering element has the shape of a plate and is intended to be arranged covering the second impeller chamber inlet. This embodiment is very favourable since the covering element provides a reliable sealing of the second impeller chamber inlet.

The invention furthermore relates to a method for changing the pumping capacity of a pump comprising: a housing; a power source; a first impeller and a second impeller. The method comprises the steps of changing the pump from a first configuration in which the first and second impeller are arranged in parallel to provide a high pumping capacity, to a second configuration in which the first and second impeller are arranged in series to provide a pump with less pumping capacity, or changing the pump from the second configuration to the first configuration.

The different embodiment described above could of course be combined and modified in different ways without departing from the scope of the invention that will be described more in detail in the detailed description.

BRIEF DESCRIPTION OF THE DRAWINGS

The invention will be explained in more detail hereinafter with reference to the drawings.

DETAILED DESCRIPTION OF THE EMBODIMENT

Figure 1:
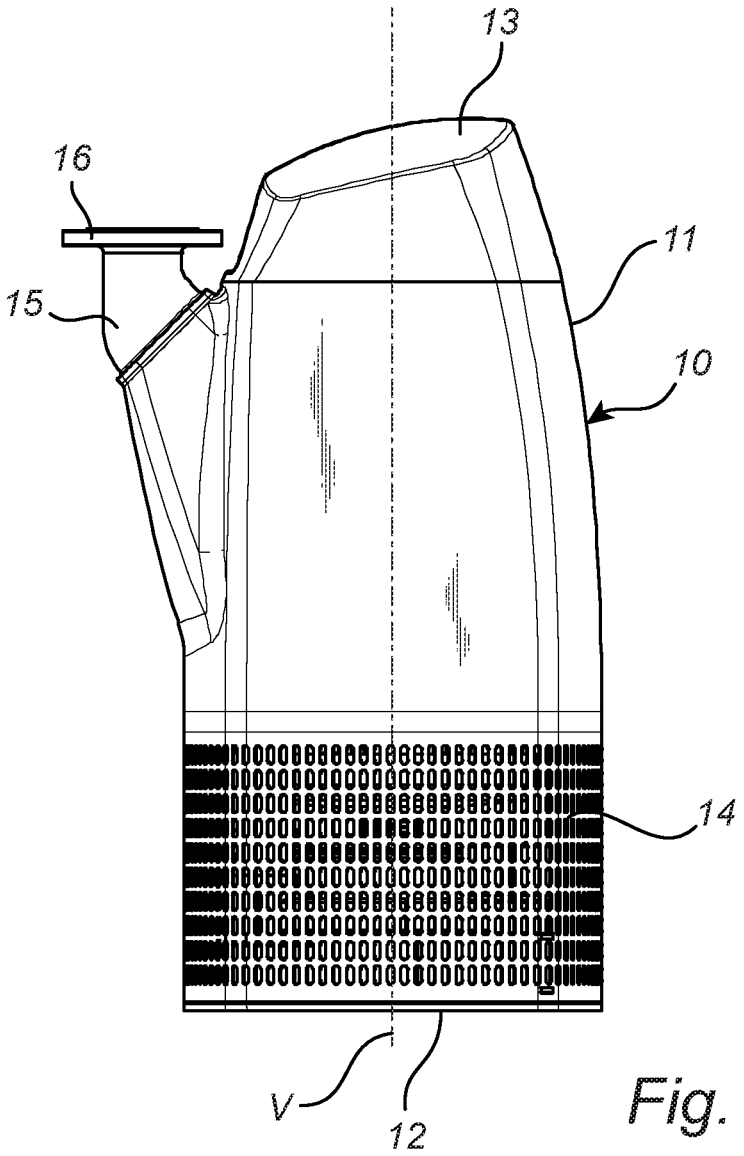
FIG. 1 illustrates a side view of a pump.

In FIG. 1 a side view of a pump 10 according to the invention is illustrated. The pump is intended for pumping fluids such as for example water. The pump comprises a pump housing 11 enclosing and protecting the different parts of the pump. The pump housing has a substantially flat bottom structure 12 intended to be arranged towards a support surface such as for example the ground surface of a mine or pit that needs to be drained.

The illustrated embodiment of the pump housing has a substantially circular cross section with a smaller radius towards the upper end of the pump. The upper end of the pump housing is ended by a top surface 13 slightly angled in relation to a plane transverse to the vertical axis V of the pump. Furthermore, since the illustrated pump comprises an electrical power source arranged within the housing, at least one cable for power supply to the pump extends through the pump housing. The at least one cable is not illustrated FIG. 1 but is preferably arranged close to the upper end of the pump housing. The pump could however also be embodied with the power source arranged separately from the pump and a drive shaft extending from the power source to the pump.

In the lower part of the housing a perforated section 14, i.e. pump inlet, is arranged to let water enter the water pump. The perforated section prevents that undesired objects enter the pump with the water which could affect the operation of the pump and eventually damage the pump. The total area of the perforated section is selected to ensure that enough water always is able to pass through the perforations and enter the water pump. The size of each opening in the perforated section could be adapted to the intended use of the pump to prevent differently sized objects to pass.

Close to the upper end of the housing an outlet pipe 15 is arranged. The outlet pipe is intended for the fluid from the pump and is ended by an attachment device 16 to make it possible to connect a pipe with suitable length and dimension to direct the fluid from the pump to the intended place where the drained fluid could be extracted.

The pump according to the invention is designed to be able to operate either in a first configuration or in a second configuration. When the pump is operated in the first configuration, i.e. the pump operating in a "low head" setup, the pump will have a high pumping capacity and when operated in the second configuration, i.e. the pump operating in a "high head" setup, the pump will have a reduced pumping capacity.

Figure 2A:
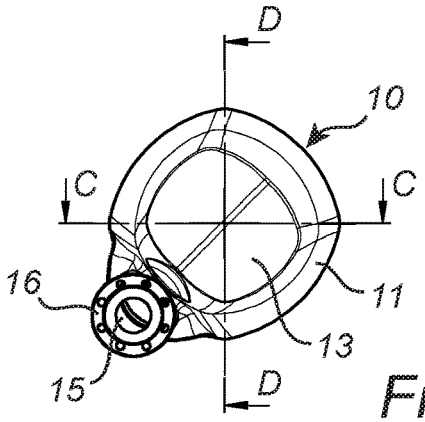
FIG. 2A illustrates a top view of the pump in FIG. 1.
Figure 2B:
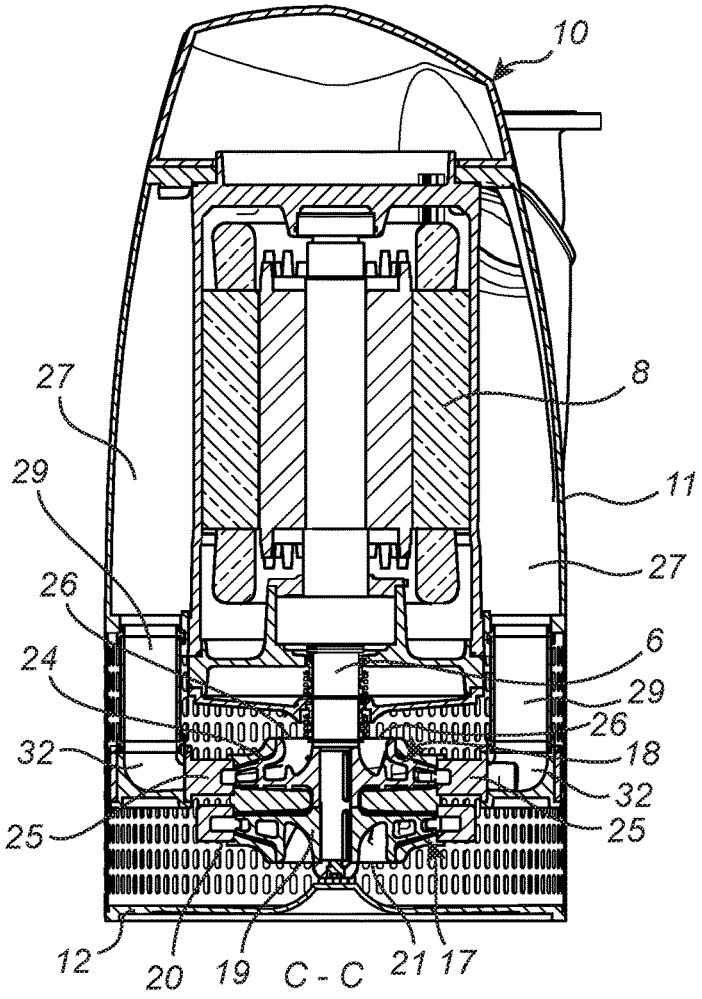
FIGS. 2B and 2C illustrates a cross sectional view of a pump according to the invention in the first configuration.
Figure 2C:
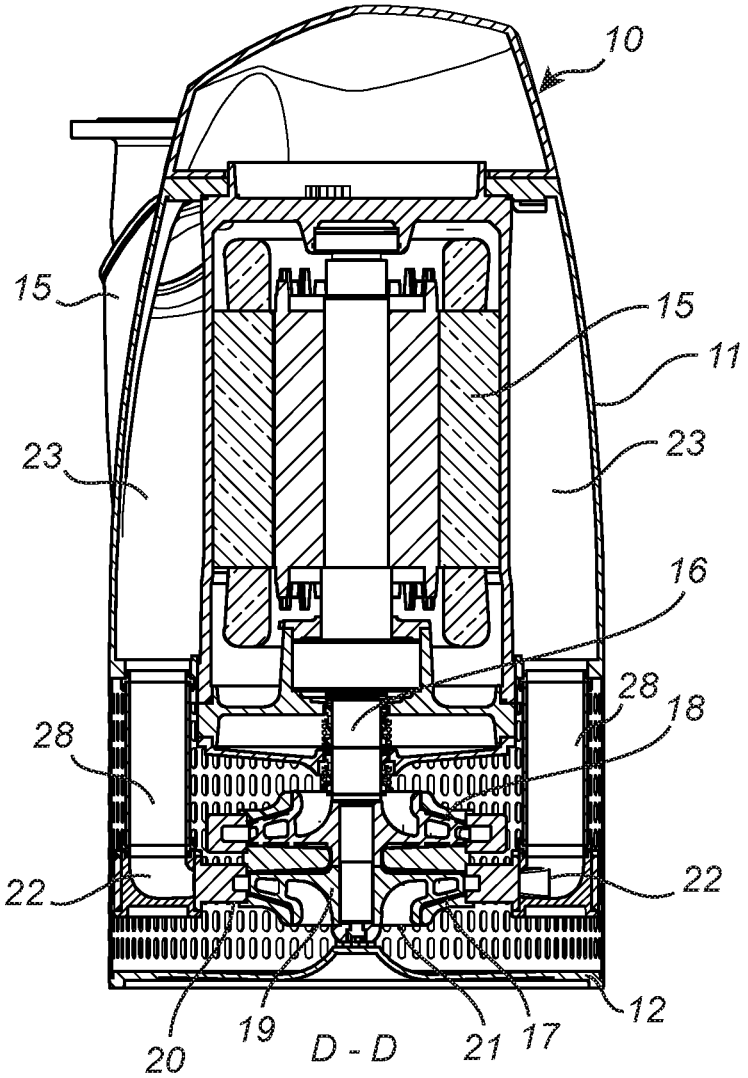
Figure 2D:
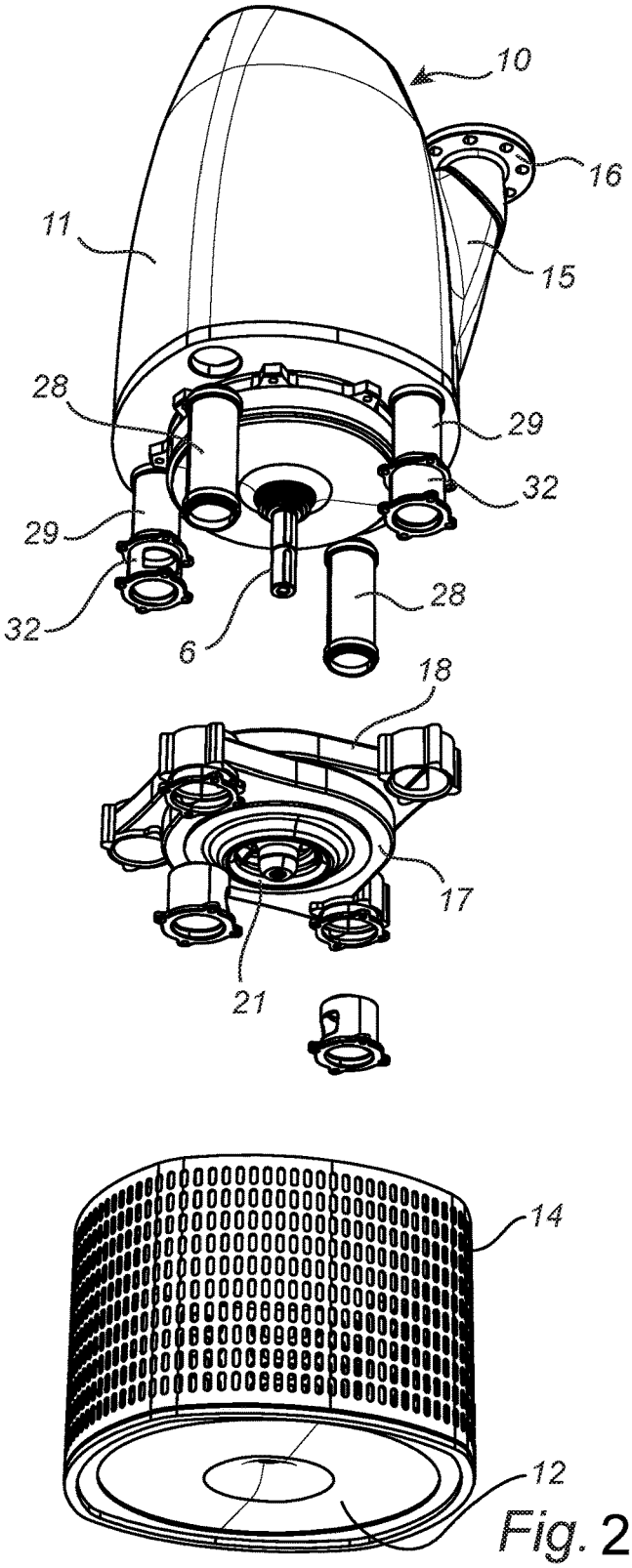
FIG. 2D illustrates an exploded view of the pump arranged in the first configuration.

FIG. 2A illustrates a top view of the pump in FIG. 1 and the position of the cross sectional views in FIGS. 2B and 2C. The pump illustrated in FIG. 2A-2C is arranged in the first configuration.

The pump 10 comprises an electrical power source/electrical motor 8 arranged within the upper part of the housing in the center of the housing. The electrical power source is arranged to power the pump via a drive shaft 6 extending substantially parallel to the vertical shaft of the pump downwards from the electrical motor. The size and power of the power source is selected to correspond to the size and desired pumping capacity of the pump.

The rotating drive shaft 6 extends downwards to a first pump device 18 and a second pump device 17 arranged along the drive shaft below the electrical motor. The second pump device is arranged closest to the bottom structure 12 of the pump housing, and the first pump device 18 arranged between the first pump device 17 and the electrical motor 8.

The second pump device 17, illustrated in FIG. 2C, comprises a second impeller 19 rotatably arranged within a second impeller chamber 20. The second impeller is arranged to be rotated by the drive shaft. The second impeller chamber has at least one impeller chamber inlet 21 arranged on the bottom side of the second pump device 17, i.e. the impeller chamber inlet 21 is arranged close to the bottom structure 12 of the pump housing 11 and in fluid connection with the space defined within the pump housing inside the perforated section 14 of the housing 11. The second pump device furthermore comprises two impeller chamber outlets 22 arranged adjacent to the outer periphery of the second impeller in radially opposite positions around the second impeller 19. The second impeller 19 has the shape of an impeller disk with guiding elements arranged on one side to generate a flow of fluid through the second pump device. The outlets 22 are curved upwards and connected to second volute tubes 28 extending from the outlets to conduits 23 extending within the pump housing to the outlet pipe 15 past the electrical power source 15 such that the fluid flowing through the conduits cools the electrical power source when the pump is running.

The first pump device 18, best illustrated in FIG. 2B, is arranged above the second pump device 17 and comprises a first impeller 24 rotatably arranged within a first impeller chamber 25. The first impeller is secured to the drive shaft and rotated simultaneously as the second impeller by the drive shaft. The first impeller chamber 25 has at least one impeller chamber inlet 26 arranged on the upper side of the first pump device 18, i.e. the impeller chamber inlet 26 is arranged facing the electrical motor and in fluid connection with the space defined within the pump housing inside the perforated section 14 of the housing 11. The first pump device furthermore comprises two impeller chamber outlets 32 arranged adjacent to the outer periphery of the first impeller in radially opposite positions around the first impeller 24. The first impeller 24 has substantially the same design as the second impeller 19 but is mirror-inverted to correspond to the position of the first impeller chamber inlet 26. The first impeller generates a flow of water through the first pump device 18 from the inlet to the outlet. The outlets 32 are curved upwards and connected to first volute tubes 29 extending from the outlets to conduits 27 extending within the pump housing to the outlet pipe 15 past the electrical power source 15 such that the water flowing through the conduits 27 cools the electrical power source when the pump is running. The conduits 27 are arranged between the outlet conduits 23 from the second pump device to provide cooling to the electrical motor via the four conduits extending past the electrical motor.

The conduits 23 in the pump housing from the first pump device and the conduits 27 from the second pump device are either embodied as separate conduits extending through the pump housing around the electric motor to cool the motor, alternatively connected to a common annular space defined within the housing around the electrical engine. Fluid is fed via the conduits to the annular space and exits the space via the outlet pipe.

Figure 3A:
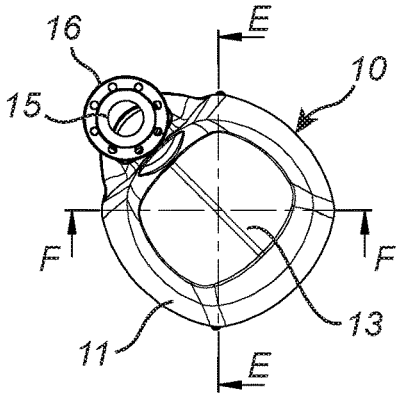
FIG. 3A illustrates a top view of the pump in FIG. 1.
Figure 3B:
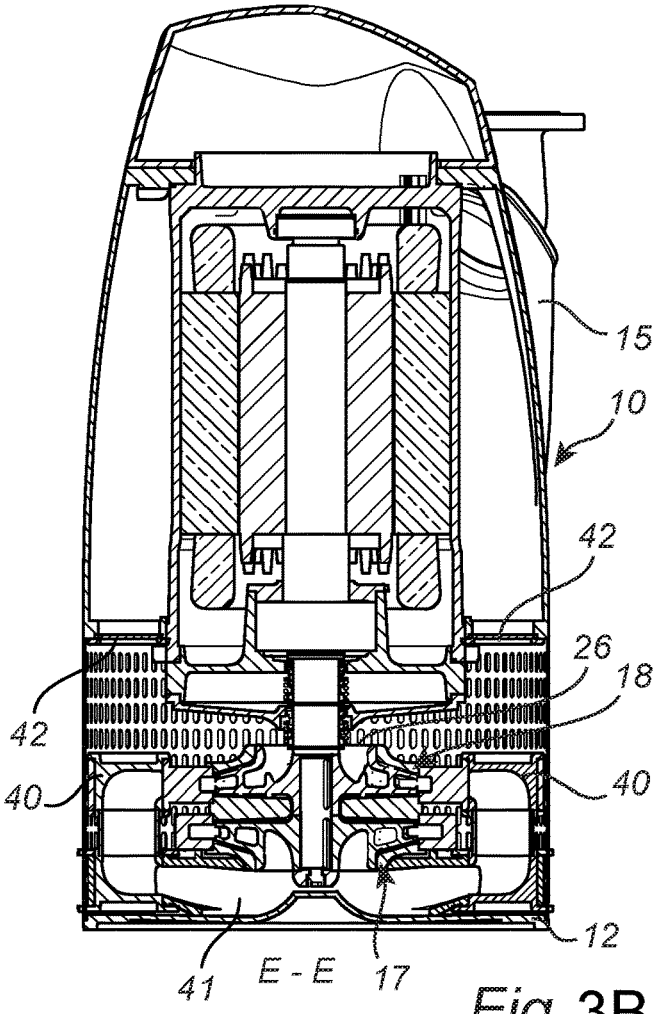
FIGS. 3B and 3C illustrates a cross sectional view of a pump according to the invention in the second configuration.
Figure 3C:
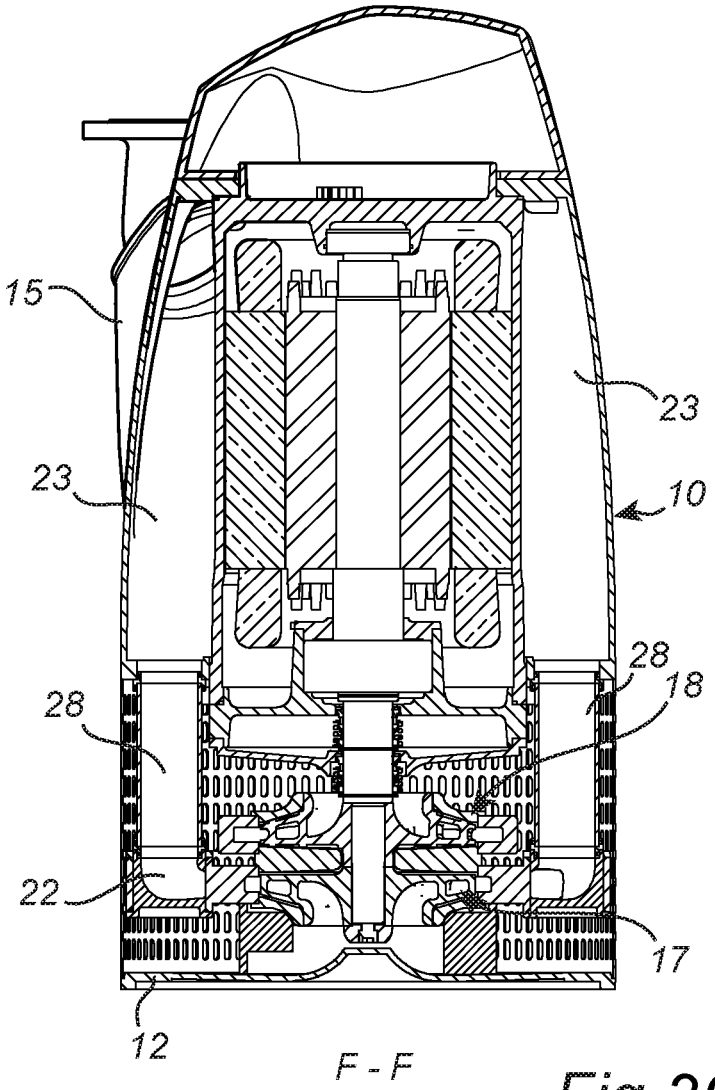

In FIGS. 3A-3C the pump has been configured in the second configuration, and FIG. 3A illustrates a top view of the pump and the position of the cross sectional views in FIG. 3B and FIG. 3C. Most of the different components of the pump 10 remain the same in both configurations and consequently the description is focused on the changed features.

In the second configuration, i.e. the configuration where the first pump device 18 and second 17 pump device are arranged in series to provide a pump with reduced pumping capacity, fluid enters the pump 10 via the first impeller chamber inlet 26. The fluid is flowing through the first impeller chamber and exits the first impeller chamber via the two impeller chamber outlets such that a flow of fluid is generated. The flow of fluid through the first pump device 18 is the same in both the first and second configuration. Instead of directing the fluid from the first pump device towards the outlet pipe 15 as in the first configuration the first impeller chamber outlets are connected to the second impeller chamber inlets such that the pumped fluid continues via the second pump device 17 before it exits the second pump device 17 via the two second impeller chamber outlets 22 connected via the second volute tubes 28 extending from the outlet 22 via conduits 23 to the outlet pipe 15. In the second configuration only two outlets 22, the second volute tubes 28 and conduits 23 are used since the pumped fluid volume is reduced.

The pump 10 is changed from the first configuration to the second configuration by opening the pump housing bottom structure 12 to access the first 18 and second pump device 17 in the lower part of the pump housing and make it possible to change the configuration within the pump housing 11.

In order to make it possible to change the pump from the first to the second configuration the following modifications need to be done:

The first volute tubes 29 extending from the first pump device outlets 32 are removed.

The outlets 32 directed upwards are plugged to redirect the flow of fluid downwards towards the second pump device 17. This is in the illustrated embodiment achieved by turning the outlets 32 upside down such that the outlets 32 constitute redirecting elements 40 connected to the first impeller chamber to direct the outlets downwards towards the second pump device. The outlets 32, i.e. redirecting elements 40, are designed to be removably fitted to the impeller chamber and redirect the fluid to flow from the outer periphery of the impeller of the first pump device downwards towards the second pump device 18. Once the redirecting elements 40 are fitted, the previously used passage that was directed upwards is closed and a new passage extending downwards is opened. The redirecting elements (outlets 32) are secured to the first pump device by screws.

The openings to the conduit 27, or annular recess, extending past the electrical power source within the pump housing are plugged by plugging plates 42 designed to fit in the openings to prevent water from flowing in the wrong direction from the conduit 27, or annular space surrounding the electrical power source. The plugging plates 42 are secured by screws.

Figure 3D:
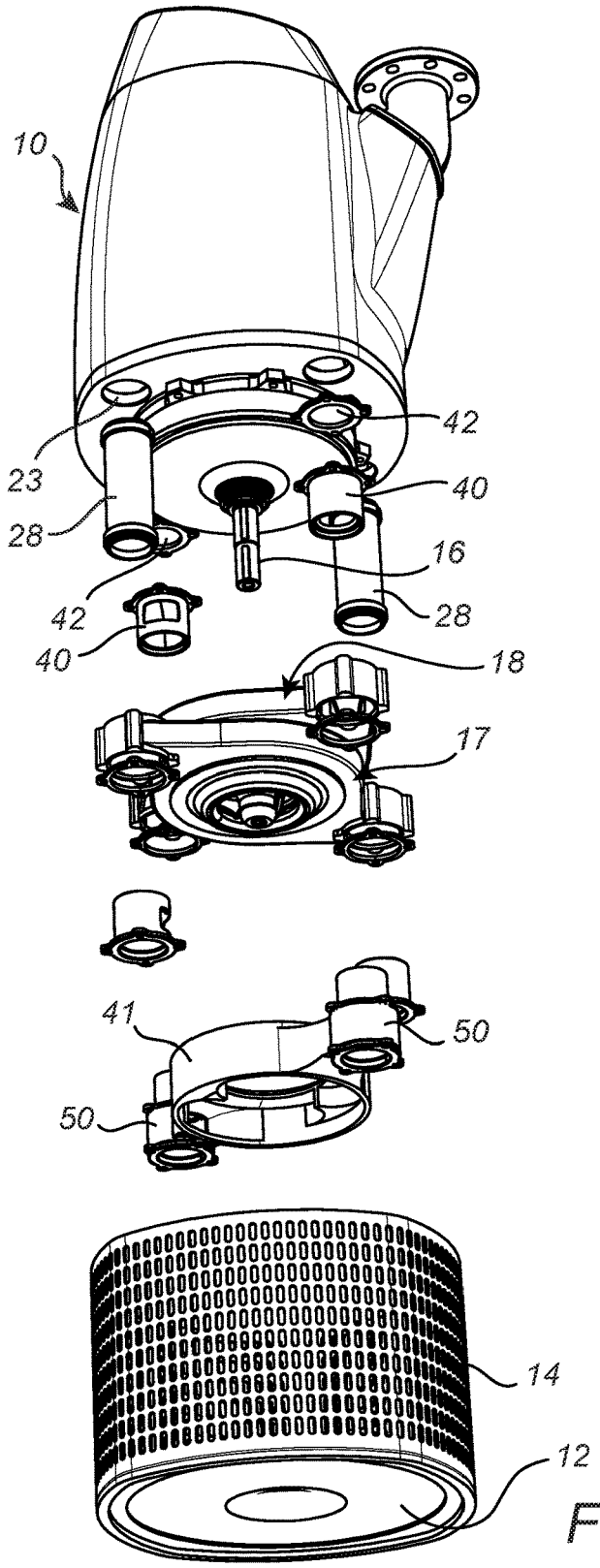
FIG. 3D illustrates an exploded view of the pump arranged in the second configuration.

The first impeller chamber outlets are connected to the second impeller chamber inlets to direct water from the first pump device 18 to the second pump device 17. This is done by adding a cover element 41, illustrated in FIG. 3D. The cover element 41 is arranged below the second pump device 17. The cover element 41 is designed to cover the second impeller inlet 21 and provide a reliable sealing that ensures that no surrounding water is entering the second pump device 17. The cover element 41 furthermore comprises connecting means or device 50 that open a passage between the first impeller chamber outlet and the second impeller chamber inlet, i.e. the cover plate 41 is connected with the redirecting elements 40 and the first pump device 18. The connecting or device extends upwards towards the first pump device 18 and when the cover element 41 is correctly fitted, the connecting device is fitted in the opening of the redirecting element 40. The covering element 41 ensures that only water from the first pump device 18 is directed to the second pump device 17. The cover element 41 is designed to create at least one connection for the fluid between the redirecting element 40 fitted to the first impeller chamber outlet and the second impeller chamber inlet. In the illustrated embodiment in FIG. 3D the cover element 41 in combination with the pump housing bottom structure together covers the second impeller chamber inlet.

In order to revert the pump from the second configuration to the first configuration the added components, i.e. the redirecting elements 40, the plugging plates 42 and the cover element 41 are removed, and the previously removed components returned to their original position within the pump.

The embodiments described above could be combined and modified in different ways without departing from the scope of the invention that is defined by the appended claims.

The invention claimed is:

1. A pump for fluids, the pump comprising:

a pump housing;

a power source enclosed within the housing;

a drive shaft connected to the power source;

at least one pump inlet arranged in the pump housing;

a pump outlet arranged in the pump housing;

a first impeller arranged within a first impeller chamber and configured to be rotated by the drive shaft; and a second impeller arranged within a second impeller chamber and configured to be rotated by the drive shaft, the pump being changeable between a first configuration in which the first and second impellers are arranged in parallel to provide a high pumping capacity, and a second configuration in which the first and second impeller are arranged in series to provide a pump with less pumping capacity than the high pumping capacity, and the first and second impeller chambers each comprises two impeller chamber outlets arranged adjacent to an outer periphery of the first and second impellers in radially opposite positions around a respective impeller.

2. The pump according to claim 1, wherein the first and second impellers are arranged at different positions along the drive shaft.

3. The pump according to claim 1, wherein the power source is an electrical or hydraulical power source arranged within the pump housing.

4. The pump according to claim 1, wherein the housing encloses the power source and is configured to prevent the fluid reaching the power source.

5. The pump according to claim 1, wherein the first impeller chamber, in which the first impeller is arranged comprises at least one first impeller chamber inlet, and the second impeller chamber, in which the second impeller is arranged, comprises at least one second impeller chamber inlet, in the first configuration, the at least one first impeller chamber inlet and second impeller chamber inlet is in fluid connection with the pump inlet, and the two impeller chamber outlets of the first impeller chamber and the two impeller chamber outlets of the second impeller chamber connected to the pump outlet, and, in the second configuration, the two impeller chamber outlets of the first impeller chamber are in fluid connection with the at least one second impeller chamber inlet and the two impeller chamber outlets of the second impeller chamber are connected to the pump outlet.

6. The pump according to claim 4, wherein the two impeller chamber outlets of the first and second impeller chambers are connected to conduits extending within the pump housing past an electrical power source to cool the electrical power source.

7. The pump according to claim 4, wherein at least one of the two impeller chamber outlets of the first impeller chamber and the two impeller chamber outlets of the second impeller chamber is connected to an annular space defined within the housing around an electrical power source to cool the electrical power source.

8. The pump according to claim 1, wherein the two outlets of the first impeller chamber are arranged radially between the two outlets of the second impeller chamber in the pump housing.

9. The pump according to claim 1, wherein the pump housing comprises a housing bottom structure removably attached to the housing.

10. The pump according to claim 1, further comprising at least one redirecting element, a covering element and at least one plugging plate that are fitted when the pump is operated in the second configuration.

11. The pump according to claim 10, wherein the redirecting element and the covering element are configured to connect the two impeller chamber outlets of the first impeller chamber with the second impeller chamber inlet.

12. The pump according to claim 10, wherein the redirecting element is configured to connect the two impeller chamber outlets of the first impeller chamber to the second impeller chamber inlet and direct the flow of fluid from the first impeller chamber to the second impeller.

13. The pump according to claim 10, wherein the covering element is a plate and is configured to be arranged covering the second impeller chamber inlet.

14. A method for changing a pumping capacity of a pump comprising a housing, a power source enclosed within the housing, a drive shaft connected to the power source, at least one pump inlet arranged in the pump housing, a pump outlet arranged in the pump housing, a first impeller arranged within a first impeller chamber and configured to be rotated by the drive shaft, and a second impeller arranged within a second impeller chamber and configured to be rotated by the drive shaft, the first and second impeller chambers each comprising two impeller chamber outlets arranged adjacent to an outer periphery of the first and second impellers in radially opposite positions around a respective impeller, the method comprising:

changing the pump from a first configuration in which the first impeller and the second impeller are arranged in parallel to provide a high pumping capacity, to a second configuration in which the first impeller and the second impeller are arranged in series to provide the pump with less pumping capacity than the high pumping capacity.

15. A method for changing a pumping capacity of a pump comprising a housing, a power source enclosed within the housing, a drive shaft connected to the power source, at least one pump inlet arranged in the pump housing; a pump outlet arranged in the pump housing, a first impeller arranged within a first impeller chamber and configured to be rotated by the drive shaft, and a second impeller arranged within a second impeller chamber and configured to be rotated by the drive shaft, the first and second impeller chambers each comprising two impeller chamber outlets arranged adjacent to an outer periphery of the first and second impellers in radially opposite positions around a respective impeller, the method comprising:

changing the pump from a second configuration in which the first impeller and the second impeller are arranged in series to provide a predetermined pumping capacity, to a first configuration in which the first impeller and the second impeller are arranged in parallel to provide the pump with higher pumping capacity than the predetermined pumping capacity.

* * * * *